US008740600B1

(12) United States Patent
Gomes

(10) Patent No.: US 8,740,600 B1
(45) Date of Patent: Jun. 3, 2014

(54) APPARATUS FOR AGGLOMERATING PARTICLES IN A NON-CONDUCTIVE LIQUID

(75) Inventor: Raymond K. Gomes, Westerly, RI (US)

(73) Assignee: Isopur Technologies, Inc., No. Stonington, CT (US)

( * ) Notice: Subject to any disclaimer, the term of this patent is extended or adjusted under 35 U.S.C. 154(b) by 1135 days.

(21) Appl. No.: 12/459,738

(22) Filed: Jul. 6, 2009

Related U.S. Application Data

(63) Continuation of application No. 11/973,225, filed on Oct. 9, 2007, now abandoned.

(51) Int. Cl.
*B03C 5/00* (2006.01)
*B03C 5/02* (2006.01)

(52) U.S. Cl.
USPC ..... 425/174.8 E; 425/3; 425/174.8 R; 425/222; 204/156; 204/164; 204/280; 204/286.1; 204/554; 204/557; 204/660; 204/664; 204/666; 204/670; 264/484; 210/243

(58) Field of Classification Search
CPC ..... B03C 5/00; B03C 5/005; B03C 5/02; B03C 5/022; B03C 5/026
USPC ..... 425/174.8 E, 174.8 R, 3, 6, 222; 264/484; 204/155, 156, 164, 279, 280, 204/286.1, 158.2, 272, 281, 554, 557, 571, 204/649, 660, 664, 665, 666, 668, 670, 672, 204/674; 210/243
See application file for complete search history.

(56) References Cited

U.S. PATENT DOCUMENTS

| | | | | | |
|---|---|---|---|---|---|
| 1,325,136 | A | * | 12/1919 | Bradley | 96/98 |
| 1,393,712 | A | * | 10/1921 | Steere et al. | 95/73 |
| 1,473,806 | A | * | 11/1923 | Bradley | 96/28 |
| 1,997,729 | A | * | 4/1935 | Herber | 96/91 |
| 2,542,054 | A | * | 2/1951 | Penney et al. | 204/666 |
| 2,592,508 | A | * | 4/1952 | Phyl | 96/98 |
| 3,117,920 | A | * | 1/1964 | Stenzel | 204/671 |
| 3,124,437 | A | * | 3/1964 | Lagarias | 95/75 |
| 3,248,857 | A | * | 5/1966 | Weindel et al. | 96/49 |
| 3,585,122 | A | * | 6/1971 | King | 204/666 |
| 3,765,154 | A | * | 10/1973 | Hardt et al. | 96/88 |
| 4,045,326 | A | * | 8/1977 | King | 204/643 |

(Continued)

OTHER PUBLICATIONS

Parker Hannifin Corp. "15/40/80 CN Series Medium Pressure Filters" p. 67-69, 77-78.

(Continued)

*Primary Examiner* — Seyed Masoud Malekzadeh
(74) *Attorney, Agent, or Firm* — C. Nessler; Tobin Carberry O'Malley Riley & Selinger PC

(57) ABSTRACT

An apparatus for charging particles in non-conductive liquids, so they agglomerate and can be removed by filtering, is comprised of a housing which contains a non-conductive insert having a multiplicity of channels. The incoming stream is divided into two halves, each of which is flowed through a set of charging channels which contain electrodes, preferably metal brush-like electrodes. One set of electrodes is charged to a high positive voltage; the other set is charged to a high negative voltage. The liquid streams are then merged and flowed trough a set of mixing channels, along the path of which are one or more reversals in flow direction. The mixing channel path length is substantially longer than the charging channel path length.

9 Claims, 10 Drawing Sheets

(56) References Cited

U.S. PATENT DOCUMENTS

| | | | | | |
|---|---|---|---|---|---|
| 4,055,479 | A * | 10/1977 | King | 204/671 |
| 4,098,673 | A * | 7/1978 | Zucker | 204/648 |
| 4,155,924 | A * | 5/1979 | Landis | 554/147 |
| 4,224,135 | A * | 9/1980 | Gidaspow et al. | 204/665 |
| 4,231,766 | A * | 11/1980 | Spurgin | 96/79 |
| 4,265,641 | A * | 5/1981 | Natarajan | 95/79 |
| 4,441,897 | A * | 4/1984 | Young et al. | 96/36 |
| 4,579,657 | A * | 4/1986 | Hood, Jr. | 210/314 |
| 4,592,836 | A * | 6/1986 | Chiao | 210/243 |
| 4,718,923 | A * | 1/1988 | Haag et al. | 96/56 |
| 4,778,584 | A * | 10/1988 | Inoue et al. | 204/272 |
| 4,874,507 | A * | 10/1989 | Whitlock | 209/11 |
| 5,009,677 | A * | 4/1991 | Wolf et al. | 95/76 |
| 5,039,318 | A * | 8/1991 | Johansson | 96/74 |
| 5,066,316 | A * | 11/1991 | Ikeda | 96/52 |
| 5,084,078 | A * | 1/1992 | Suzuki et al. | 96/52 |
| 5,240,575 | A * | 8/1993 | Mathur et al. | 204/177 |
| 5,242,587 | A * | 9/1993 | Barrington et al. | 210/223 |
| 5,308,586 | A * | 5/1994 | Fritsche et al. | 204/562 |
| 5,330,559 | A * | 7/1994 | Cheney et al. | 95/63 |
| 5,348,571 | A * | 9/1994 | Weber | 96/68 |
| 5,352,347 | A * | 10/1994 | Reichert | 204/665 |
| 5,458,748 | A * | 10/1995 | Breault et al. | 204/177 |
| 5,474,600 | A * | 12/1995 | Volodina et al. | 96/57 |
| 5,593,560 | A * | 1/1997 | Inoue | 204/671 |
| 5,626,652 | A * | 5/1997 | Kohl et al. | 96/45 |
| 5,630,926 | A * | 5/1997 | Thompson | 204/665 |
| 5,707,428 | A * | 1/1998 | Feldman et al. | 96/54 |
| 5,736,024 | A * | 4/1998 | Seo | 204/554 |
| 5,785,834 | A * | 7/1998 | Thompson | 204/562 |
| 5,788,827 | A | 8/1998 | Munson | |
| 5,922,111 | A * | 7/1999 | Omi et al. | 96/60 |
| 5,954,933 | A * | 9/1999 | Ingalls et al. | 204/557 |
| 6,071,330 | A * | 6/2000 | Matsubara et al. | 96/69 |
| 6,126,803 | A * | 10/2000 | Halm et al. | 204/572 |
| 6,136,174 | A * | 10/2000 | Berry et al. | 204/671 |
| 6,193,782 | B1 * | 2/2001 | Ray | 95/4 |
| 6,294,003 | B1 * | 9/2001 | Ray | 96/49 |
| 6,527,829 | B1 * | 3/2003 | Malkamaki et al. | 95/71 |
| 6,872,238 | B1 * | 3/2005 | Truce | 95/29 |
| 6,901,808 | B1 * | 6/2005 | Sharpless et al. | 73/724 |
| 7,163,624 | B2 * | 1/2007 | Nilsen et al. | 210/243 |
| 7,318,857 | B2 * | 1/2008 | Ray et al. | 96/44 |
| 7,374,655 | B2 * | 5/2008 | Roberts et al. | 205/701 |
| 7,862,702 | B2 * | 1/2011 | Gascoyne et al. | 204/643 |
| 8,211,284 | B2 * | 7/2012 | Hamid et al. | 204/660 |
| 8,293,091 | B2 * | 10/2012 | Munson et al. | 204/665 |
| 8,308,926 | B2 * | 11/2012 | Liu et al. | 204/643 |
| 8,414,777 | B2 * | 4/2013 | Bjorklund et al. | 210/708 |
| 8,449,750 | B2 * | 5/2013 | Hamid et al. | 204/661 |
| 2001/0023589 | A1 * | 9/2001 | Tamura et al. | 60/747 |
| 2002/0011405 | A1 * | 1/2002 | Avnery | 204/158.2 |
| 2003/0085128 | A1 | 5/2003 | Toffolo | |
| 2004/0011651 | A1 * | 1/2004 | Becker et al. | 204/547 |
| 2004/0169501 | A1 | 9/2004 | Munson | |
| 2005/0036924 | A1 * | 2/2005 | Nilsen et al. | 422/186.04 |
| 2005/0145576 | A1 | 7/2005 | Munson | |
| 2005/0183964 | A1 * | 8/2005 | Roberts et al. | 205/701 |
| 2006/0254920 | A1 * | 11/2006 | Gascoyne et al. | 204/547 |
| 2006/0261265 | A1 * | 11/2006 | Ray et al. | 250/281 |
| 2006/0289341 | A1 * | 12/2006 | Muller et al. | 209/210 |
| 2010/0326831 | A1 * | 12/2010 | Munson et al. | 204/555 |
| 2011/0031123 | A1 * | 2/2011 | Schulze et al. | 204/547 |
| 2012/0031759 | A1 * | 2/2012 | Hausmann et al. | 204/547 |
| 2012/0305398 | A1 * | 12/2012 | Muller et al. | 204/545 |
| 2013/0043132 | A1 * | 2/2013 | Liu et al. | 204/547 |

OTHER PUBLICATIONS

General Electric Co. "Technical Information Letter, Lube Oil Varnishing (TIL 1528)" p. 1-4 (Nov. 18, 2005).

G.L. Munson, Gas Turbine Varnish Remediation During Normal Operation Using Balanced Charge Reclomeration Technology, 7 pages (2005).

R. Gomes Description of Commercial Products of ISOPUR Techonologies Inc. (1) page (Sep. 17, 2009).

* cited by examiner

APPARATUS FOR AGGLOMERATING PARTICLES IN A NON-CONDUCTIVE LIQUID

This application is a continuation of patent application Ser. No. 11/973,225, filed Oct. 10, 2007, now abandoned.

TECHNICAL FIELD

The present invention relates to filtering of non-conductive liquids by a process which includes flowing the liquid past high voltage electrodes.

BACKGROUND

A particular kind of apparatus, such as described in U.S. Pat. No. 5,788,827 of Munson, has been used in commerce for removing very fine particles from non-conductive liquids, such as lubricating oil used in large machines. The process carried out by the apparatus involves dividing a liquid stream into two portions, and contacting the portions respectively with high voltage positive and negative electrodes, so that the particles become charged. Then, the liquid stream portions are re-combined, and the particles agglomerate, making them much easier to remove by downstream depth filtration.

There is a continuing desire to improve the performance of the foregoing kind of apparatus, and to provide apparatus which is more easily and economically constructed than in the past.

SUMMARY OF THE INVENTION

An object of the invention is to improve an apparatus and method for filtering, in particular to improve the way in which particles are charged. A further object is to simplify and reduce the cost of the construction and assembly of particle-agglomerating filtering apparatus. Other objects of the present invention, as well as particular features, elements, and advantages thereof, will be apparent from the following description and the accompanying drawings.

In accord with an embodiment of the invention, a stream of non-conductive liquid containing particulate contaminant is treated by dividing the stream into two halves and flowing the stream halves through separate charging channels which contain charging electrodes. One set of charging channels has electrodes with a high positive voltage; the other set of one or more charging channels has electrodes charged to a high negative voltage. For example, up to 15,000 volts plus and 15,000 volts minus may be used. Upon exiting the charging channels, the two liquid streams are merged and flow along a lengthy up and down path within a set of one or more mixing channels. Due to the effects of the high voltage and the charge imparted to the particles, the particles agglomerate in the mixing channels, which facilitates their subsequent removal from the liquid. In an improvement, the electrodes are comprised of conductive bristles, preferably a row of metal bristles which spirals along a conductive post; and preferably there are three parallel helical bristle electrodes in three parallel charging channels.

In an embodiment of the invention, channels run vertically up and down along the length of the body of a non-conductive plastic insert contained within a housing which receives and discharges the oil stream being treated. A bottom cap and upper cap are mated with an insert body, to direct the flow between the channels in the body. The inflow to the insert is first divided into two separate stream portions by the top cap. Each portion flows through a set of charging channels, preferably vertically down channels in the body of the insert. At the bottom of the body is a bottom cap which merges the two stream half portions. The merged liquid stream flows upwardly to the top cap, and then downwardly through the body to the bottom cap, and then again to the top cap, through a set of one or more mixing channels. The stream then exits the top cap, and flows to the outlet of the housing within which the insert is contained. The length of the flow path from beginning to end of the mixing channels is substantially greater, preferably about three times greater, than the flow path length from beginning to end, through the charging channels. The cross sectional area of the entry openings of the charging channels is substantially greater than the cross sectional area of the mixing channels, preferably about three times greater.

In use of the invention, particles within the liquid are charged and agglomerate. The invention is convenient to fabricate and assemble. The foregoing and other objects, features and advantages of the present invention will become more apparent from the following description of preferred embodiments and accompanying drawings.

DESCRIPTION

This application is a continuation of application Ser. No. 11/973,225, filed Oct. 9, 2007, the disclosure of which is hereby incorporated by reference. The invention embodiments herein are described with reference to the illustrations, which for convenience of description show the apparatus in vertical orientation, typical of how the device is used. However, the invention may be used in other orientations.

In an embodiment of the invention, a housing 30 contains an insert 40 which has a multiplicity of internal channels for liquid flow. Liquid being treated enters the top end of the housing and is divided into two streams as it enters the channel openings at the top of the upper part of the insert. Each stream flows internally in the insert, first past a charging electrode and then to a point of merger with the other stream. The merged streams then flow through a series of channels, finally to the top of the insert, and then to the exit of the housing.

Figure 1:
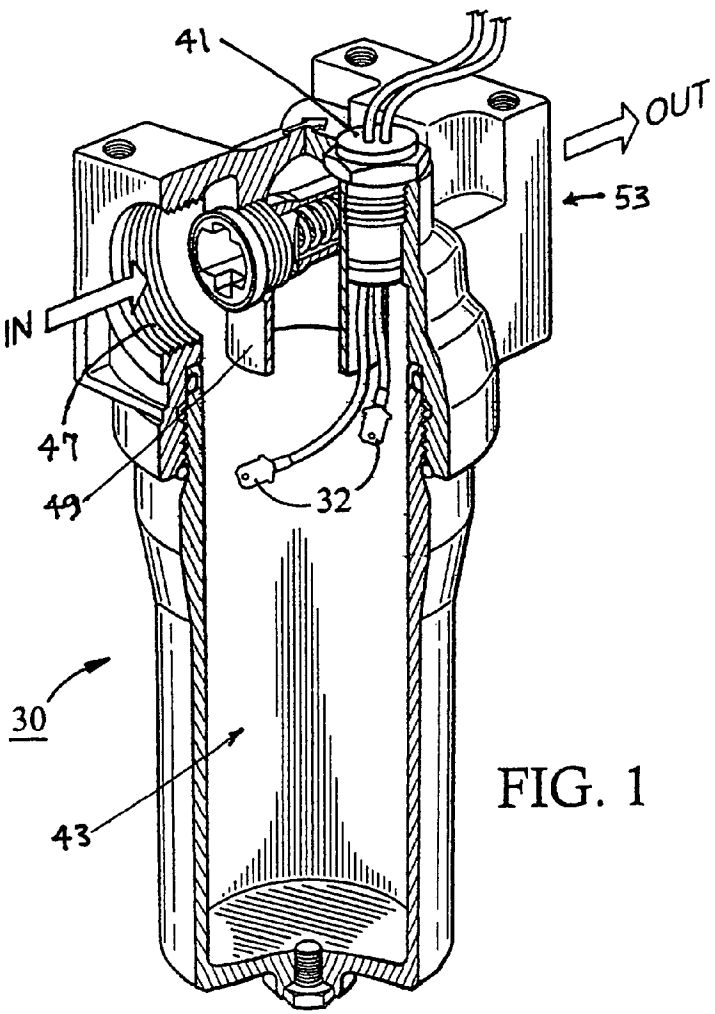
FIG. 1 is an isometric view, partially cut-away, of a housing.

FIG. 1 shows housing 30 in partial cutaway. Housing 30 may be the housing of a commercial filter used for other kind of filtering apparatus; in particular, it may be a portion of a 15/40/80CN Series filter assembly sold by Parker Hannifin Corporation, Metamora, Ohio. (As sold by Parker Hannifin, the filter assembly comprises a filter element and an electric sensor. These are not used in the invention.) Housing 30 has a fitting 41 for passage of two electrical leads 32 through the wall of the housing. Each lead respectively carries positive and negative voltage to terminals 90 at the upper ends of each of the two charging electrode assemblies 80, as described below.

Figure 2:
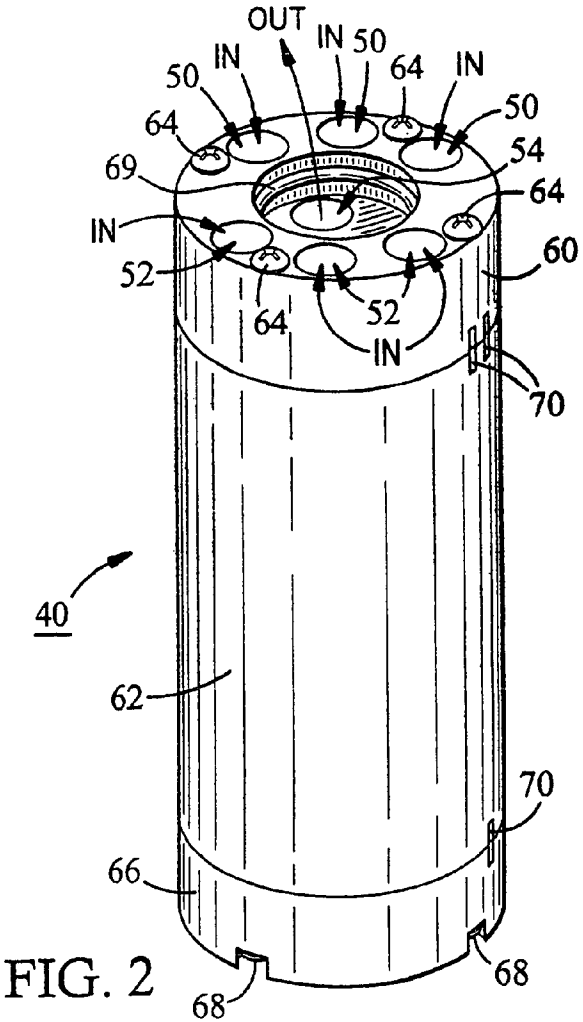
FIG. 2 is an isometric view of an insert, comprised of a body, top cap, and lower cap, which is placed within the housing of FIG. 1 during use.
Figure 6:
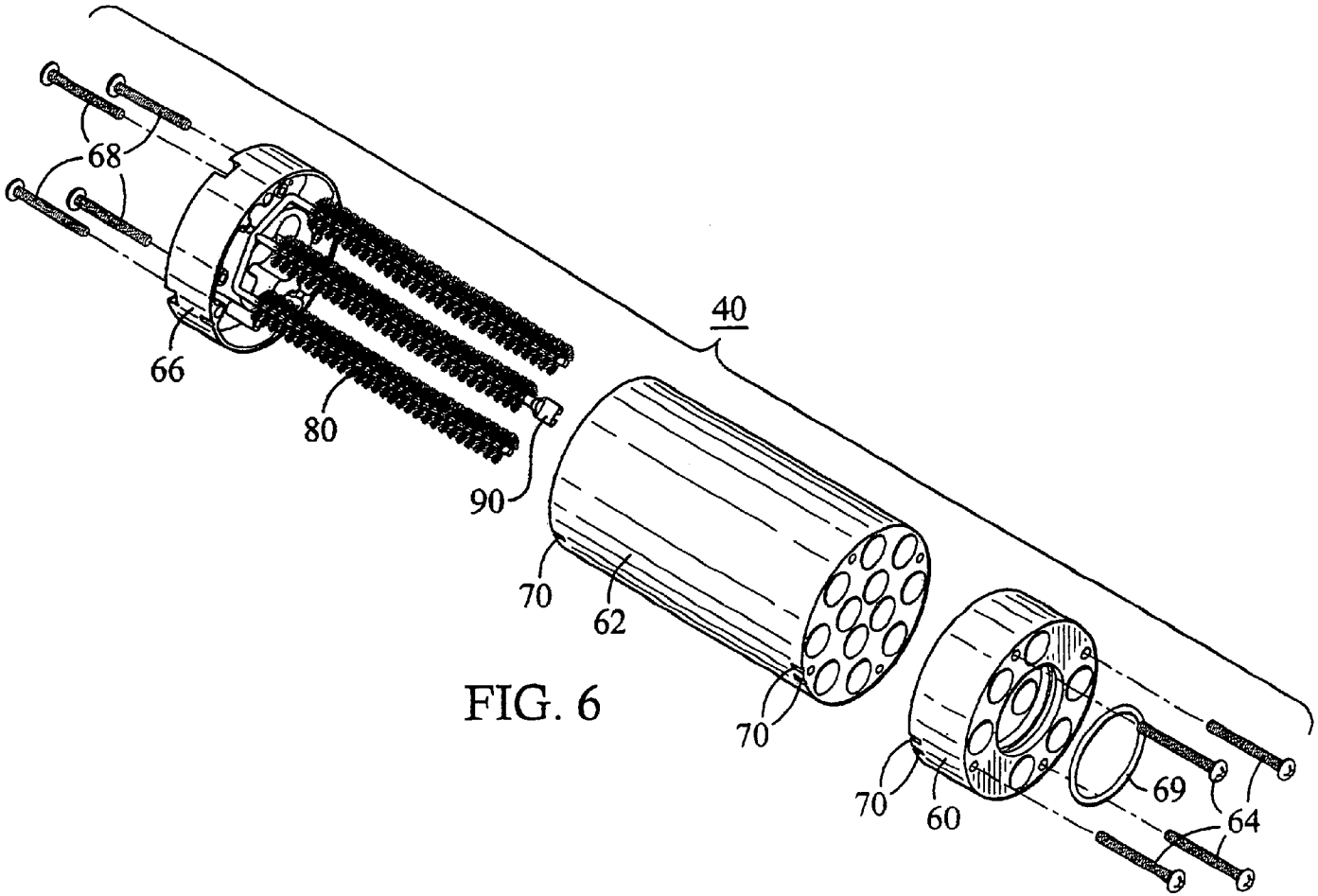
FIG. 6 is an exploded isometric view of an insert with one of two charging electrode assemblies.
Figure 7:
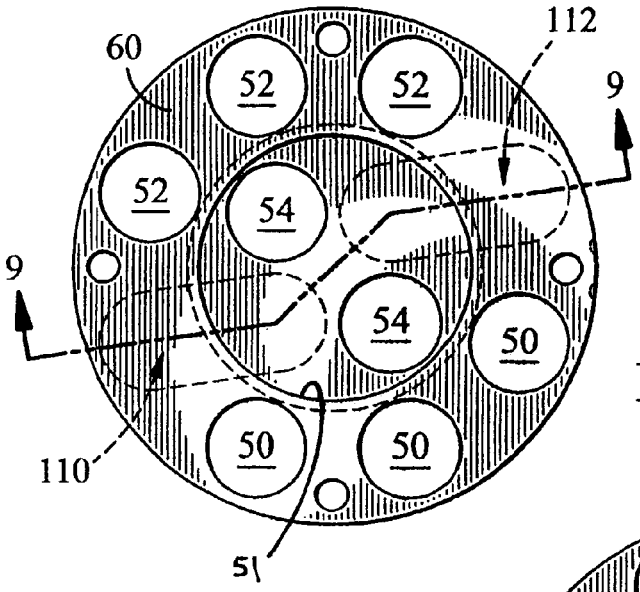
FIG. 7 is a view looking downwardly on the top cap of the insert.
Figure 8:
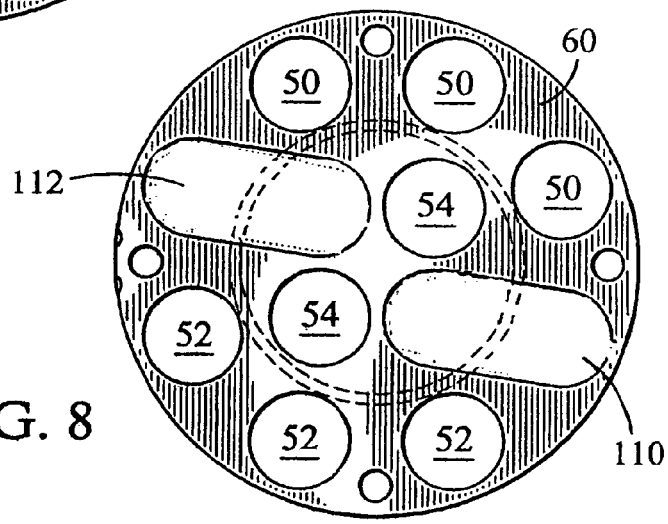
FIG. 8 is a plan view showing the interior side of the insert top cap.
Figure 9:
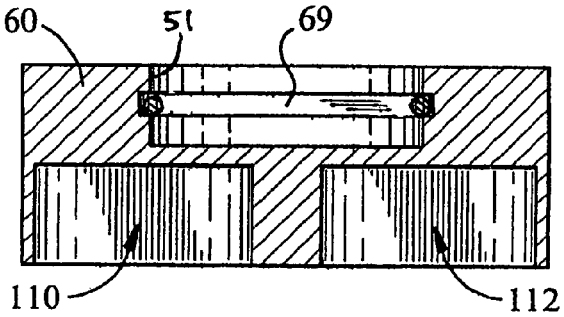
FIG. 9 is a vertical cross section view of the insert top cap, along line 9-9 of FIG. 7.

FIG. 2 shows a non-electrically conductive insert 40 which is, during use of the apparatus, inserted into interior cavity 43 of housing 30. Insert 40 is an assembly of three separately fabricated elements, namely top cap 60, body 62, and bottom cap 66. The exploded view of FIG. 6 shows how the portions fit together and how they contain the electrodes. Top cap 60 of insert 40 is secured to body 62 by means of four screws 64; and, bottom cap 66 is secured to the body 62 by means of four screw 68. Index marks 70 are provided on the mating pieces to insure that those portions are properly aligned to each other upon assembly. Insert 40 may be constructed of nylon, or another non-electrically conductive material compatible with the liquid being handled. Insert body 62 has a plurality of round channels, 50, 52, 54 and 102. As will be appreciated, the diameter of the channels may vary according to the size of the housing and the liquid flow contemplated.

Figure 10:
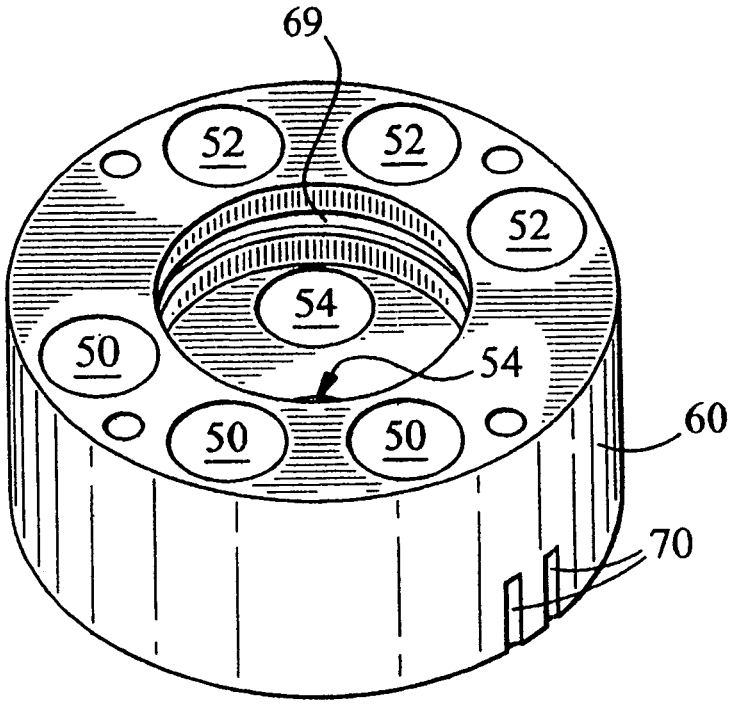
FIG. 10 is an isometric view looking showing the upper side of the insert top cap.
Figure 11:
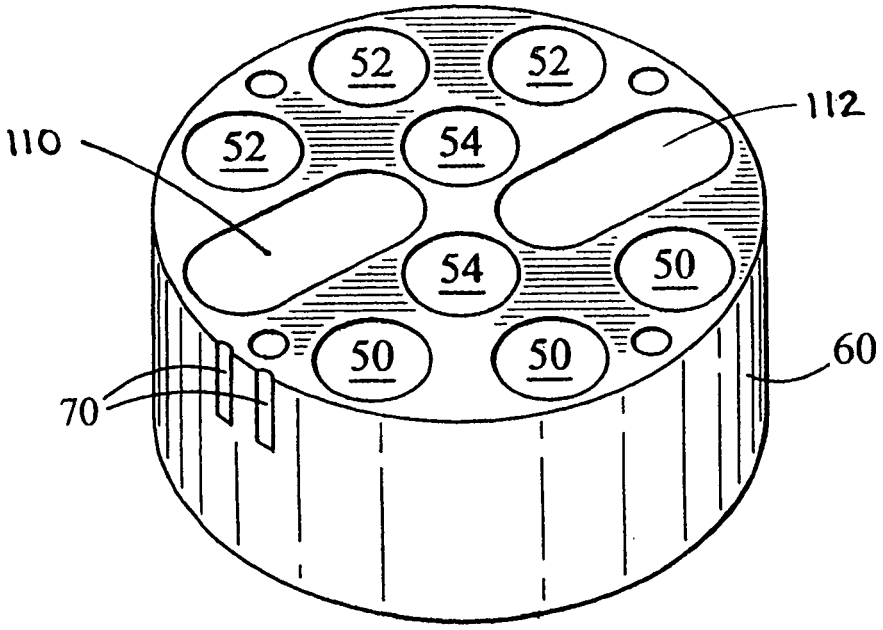
FIG. 11 is an isometric view showing the interior side of the insert top cap.
Figure 12:
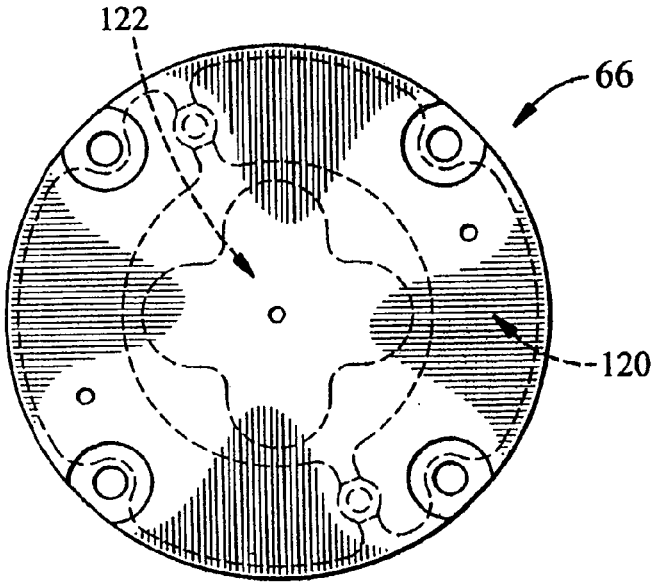
FIG. 12 shows the lower or exterior surface of the insert bottom cap.
Figure 13:
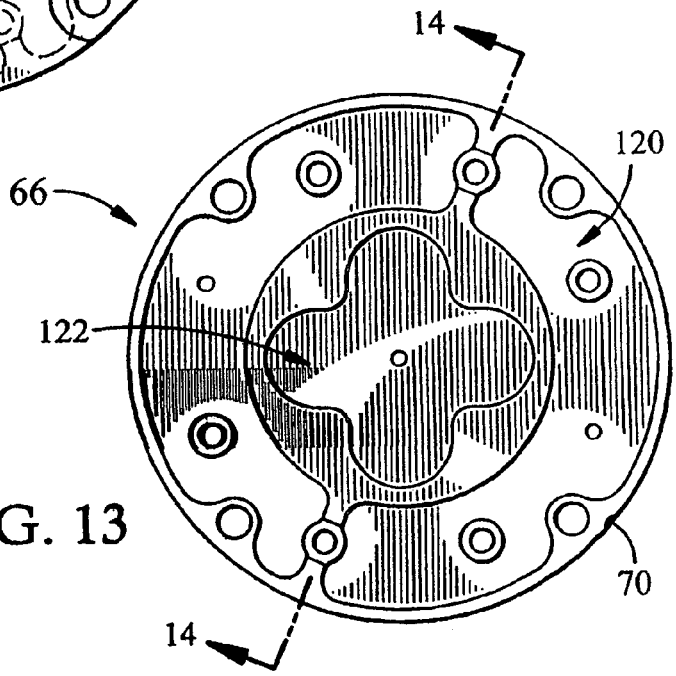
FIG. 13 shows the upper or interior surface of the bottom cap.
Figure 14:
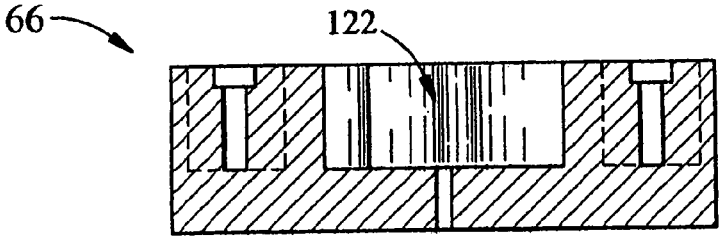
FIG. 14 is a sectional view of the insert bottom cap along line 14-14 of FIG. 13.
Figure 15:
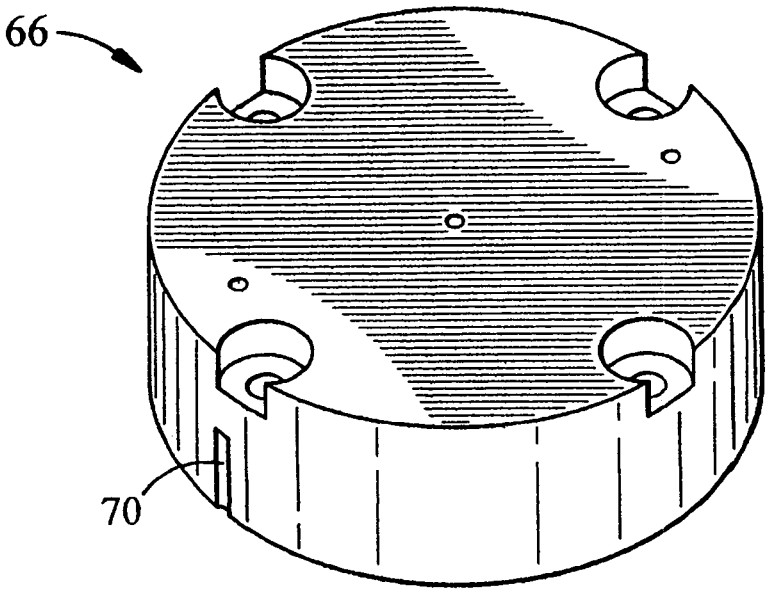
FIG. 15 is an isometric view showing the lower or exterior surface the bottom cap.

In use, when insert 40 is positioned within housing 30, the liquid being treated flows through the inlet 47 of the housing 30 into portion of interior cavity 43 which is above the insert. Skirt 49 of the housing 30 extends downwardly from the interior top of the housing; and, it is received in the recess 51 of insert top cap 60, and sealed by o-ring 69. Thus, the in-flowing liquid can only flow around the exterior of skirt 49, and the liquid flows to and through the six open upper ends of a first set of three channels 50 and a second set of three channels 52, which open ends are arranged around insert top cap 60, as can be seen in FIG. 10.

Figure 22:
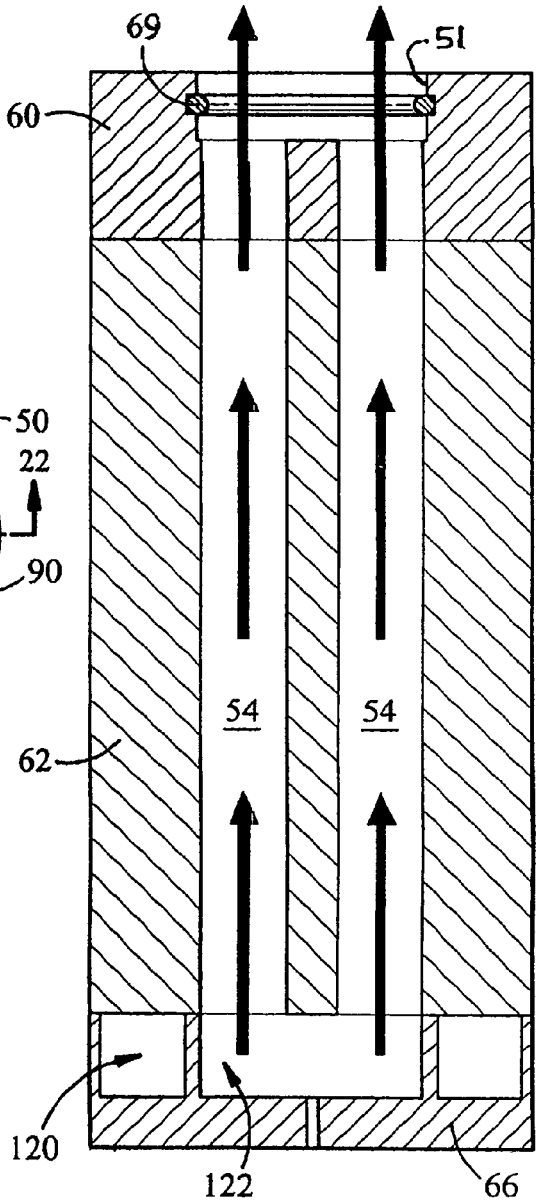
FIG. 22 is a side elevation view like FIG. 18, taken along line 22-22 of FIG. 19, and showing the paths of the liquid.

As described further below, the two sets of channels 50 and 52 comprise two parallel flow paths. In particular, the three channels 50 define a first flow path for a first stream portion. And the three channels 52 define a second flow path for a second stream portion. The symmetry of the upper openings of the channels 50, 52 at the top of the insert 40 comprises means which causes approximately fifty percent of the liquid to follow each of two parallel stream flow paths. The channels 50, 52 which contain electrodes 81 are called charging channels because particles in the liquid are charged by the electrodes in such channels. The other channels of the insert are called flow-mixing channels, because the liquid streams which exit the two sets of the charging channels have flow through them as merged streams. After traveling within the insert and through the mixing channels, liquid exits insert 40 by flowing out of the two upper ends of channels 54 in top cap 60, and then toward housing exit port 53. See FIGS. 2, 10 and 22.

Figure 3:
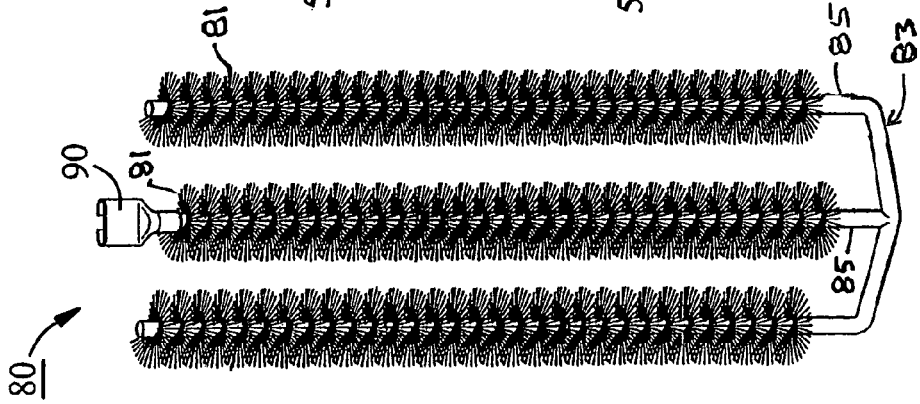
FIG. 3 is an isometric view of a three unit charging electrode assembly.
Figure 16:
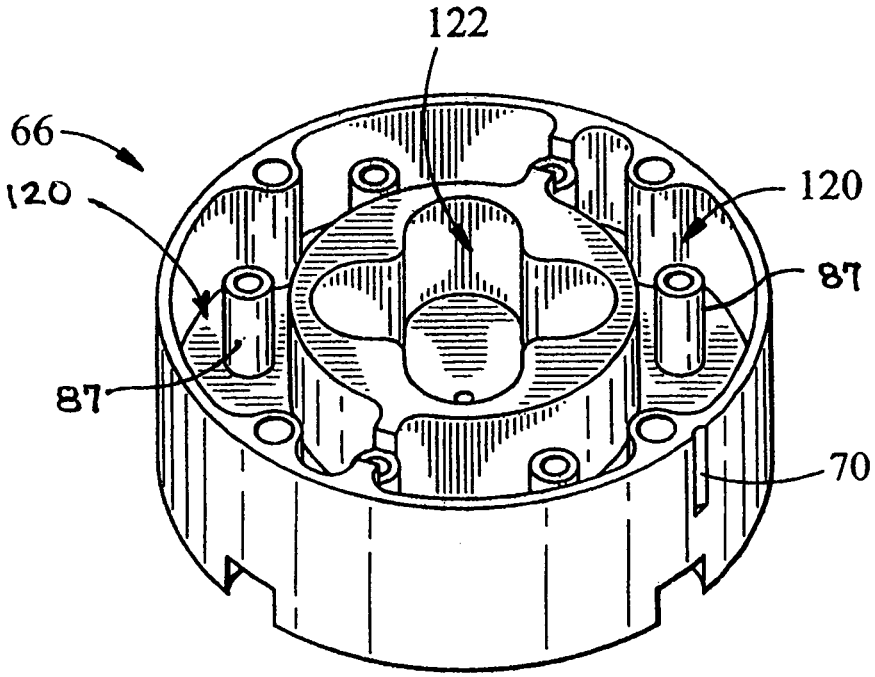
FIG. 16 is an isometric view showing the upper or interior of the bottom cap.
Figure 18:
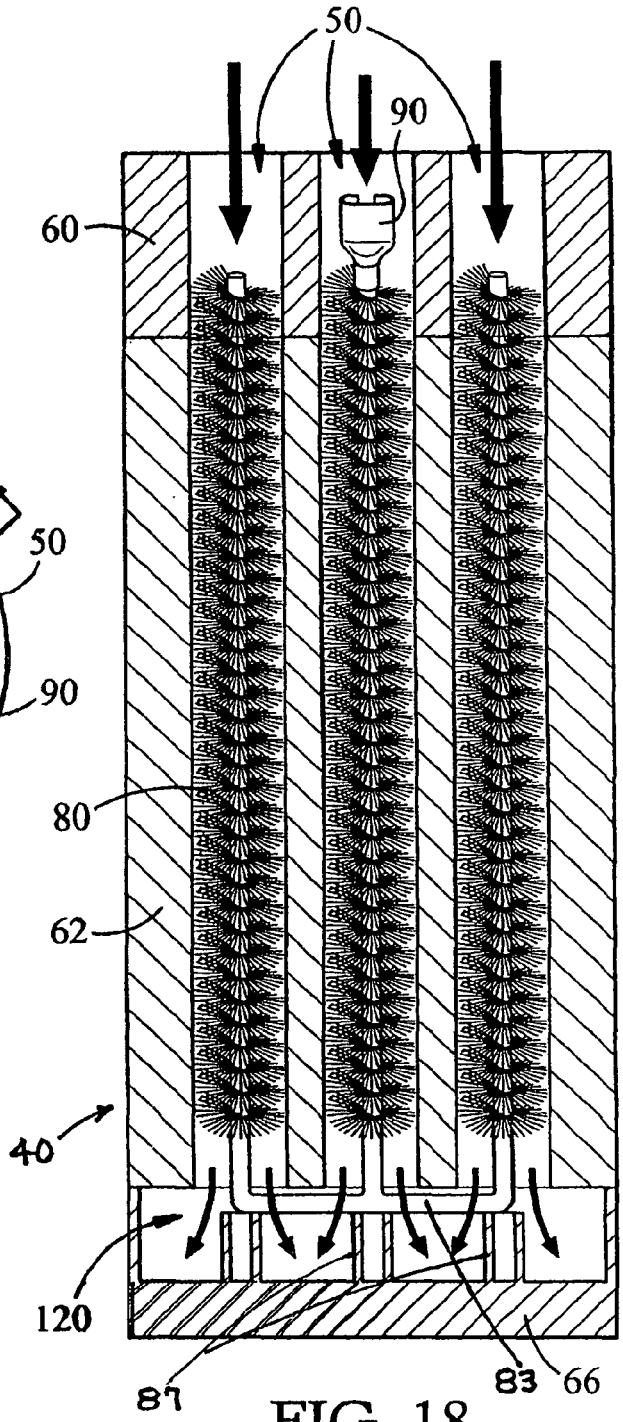
FIG. 18 is a side elevation sectional view of the insert of FIG. 2 with the electrodes in place, taken along line 18-18 of FIG. 17. The arrows show the liquid flow paths.
Figure 19:
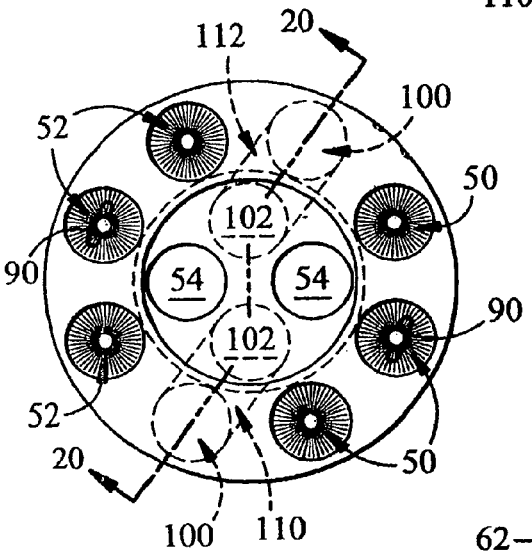
FIG. 19 is top view like FIG. 17.
Figure 20:
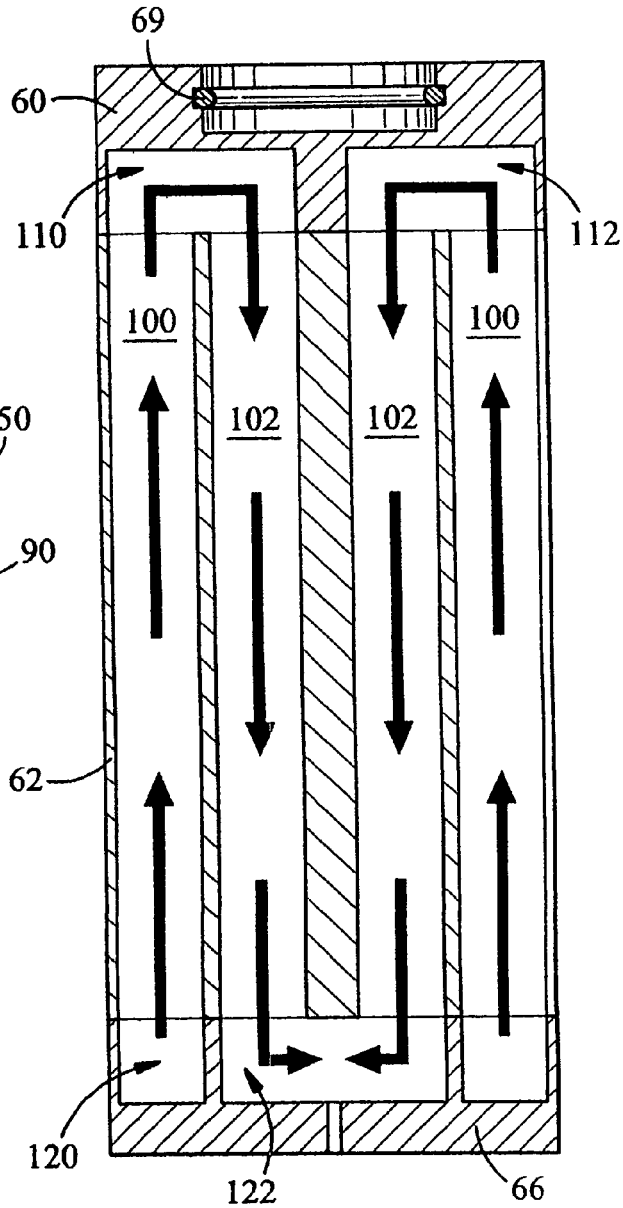
FIG. 20 is a side elevation sectional view like FIG. 18, taken along line 20-20 of FIG. 19. The arrows show liquid flow paths.
Figure 21:
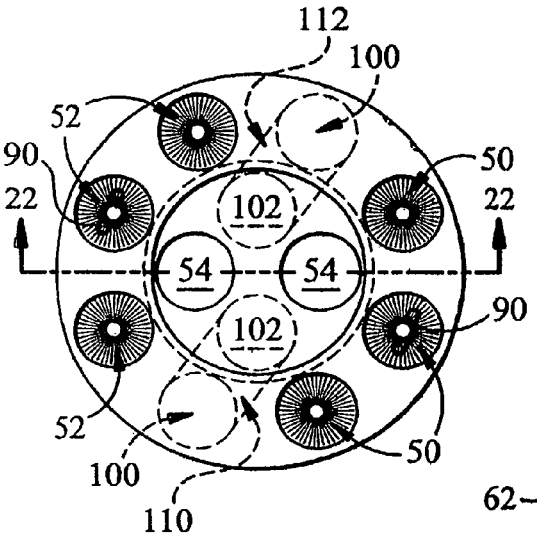
FIG. 21 is top view like FIG. 17.

FIG. 3 illustrates one of two electrode assemblies 80, also called charging assemblies. Each assembly 80 is comprised of three electrical elements 81, which are also referred to as charging electrodes. The three electrodes are electrically connected in parallel at their lower ends by trident bus 83. The electrodes 81 of a first assembly 80 are positioned within the three parallel channels 50 of the insert 40. The electrodes 81 of a second charging assembly 80 are positioned in the three parallel openings 52. See the exploded view of FIG. 6 (where only one of the two assemblies 80 is shown for simplicity of illustration). The cutaway view of FIG. 18 shows a charging assembly in position within the insert. As shown in FIG. 16, as well as FIG. 18, the insert bottom cap 66 has six supports 87, for supporting the electrode assemblies at the trident busses 83.

Each electrode 81 comprises a post 85 of about one-eighth inch diameter. The bottom ends of the posts 85 connect to trident bus 83. In each electrode 81 a multiplicity of bristles project radially outwardly from the post 85 and toward the bore of the channel in which the electrode is positioned. The row of bristles helically rises (spirals) upwardly along the length of the post. The turns of the bristle row are spaced apart vertically on one-quarter inch centers. The bristles comprise wires and the electrode is about 0.9 inch diameter. As pictured, each electrode 81 extends nearly fully along the length of the channel in which it is positioned. Each electrode assembly 80 has an electrical connector 90 at its upper end, for connection to one of electrical leads 32 illustrated in FIG. 1. Charging electrodes 80 are made of stainless steel, or another electrically conductive material compatible with the liquid handled.

Figure 5:
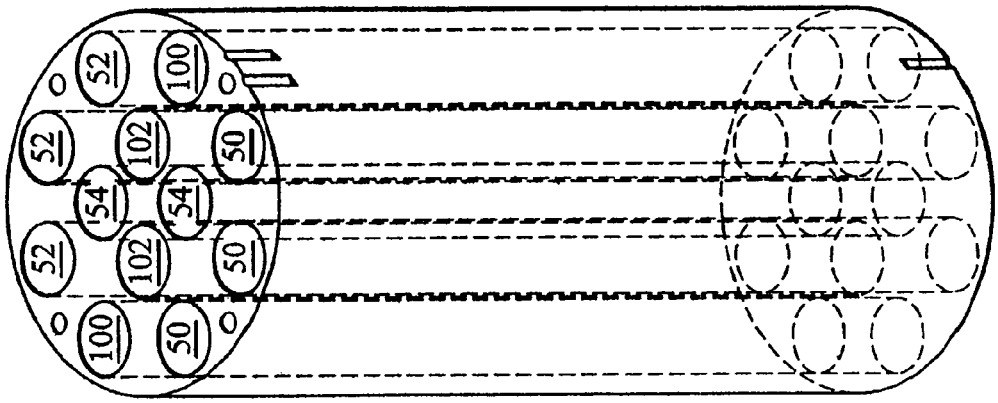
FIG. 5 is an isometric view of an insert body showing in phantom the internal liquid flow channels.
Figure 4:
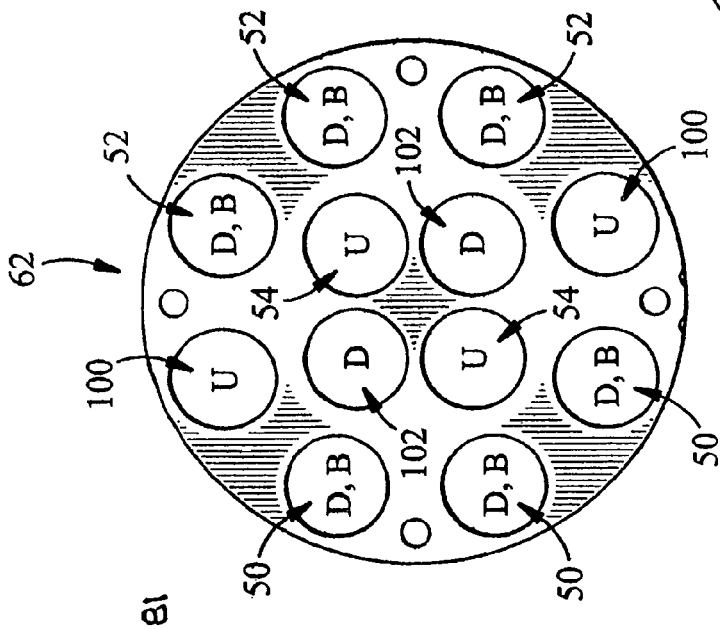
FIG. 4 is a top view of the insert body of FIG. 2, showing the directions in which liquid flows within the vertical-running channels of the insert body.

FIG. 5 shows the path of the channels inside body 62 of insert 40. FIG. 4 indicates the direction of the flow in each channel, with "D" indicating that the flow is down, and "U" indicating that the flow is up. "D.B." indicates that the flow is downwardly and also past a charging electrode.

FIGS. 19-22 are cross sections of the insert in different planes. The bold arrows in the channels indicate the direction in which liquid flows within the channels of three parts 60, 62, 66 of the insert. The drawings and flow indications are mutually supportive of how the insert is constructed and the method of the invention. In brief, the divided halves of the liquid stream, which down-flow past the charging assemblies, meet in space 120 of the bottom cap. The re-merged or mixed liquid then flows upwardly to the top cap, then downwardly to the bottom cap again, then upwardly to and through the top cap and out of the housing 30.

FIGS. 12-16 illustrate insert bottom cap 66. The bottom cap is shaped so that liquid, which flows downwardly through channels 50 of the insert body and into the cap 66, flows into cavity 120. Likewise, liquid flowing downwardly through channels 52 flows into cavity 120. The two liquid streams merge in cavity 120 and flow upwardly through diametrically opposed channels 100 of body 62. Note that channels 100 are located between the diametrically opposed sets of channels 50 and 52. The remainder of the channeled flow in the insert, which is upward, downward and then upward again, enables mixing of the merged streams.

FIGS. 7-11 illustrate insert top cap 60. Cavity 110 connects one up-flow channel 100 with a down-flow channel 102. Cavity 112 connects the other opposing side up-flow channel 100 and the opposing side down-flow channel 102. See FIG. 20.

Referring again to FIGS. 12-16, cavity 122 of insert bottom cap 66 connects the lower ends of both down-flow channels 102. Liquid which is thus further mixed in cavity 122 flows upwardly through the up-flow channels 54 to the top cap. See FIG. 22. Liquid then exits the top cap, to flow within the interior of skirt 49 and then out the exit 53 of housing 30.

Figure 17:
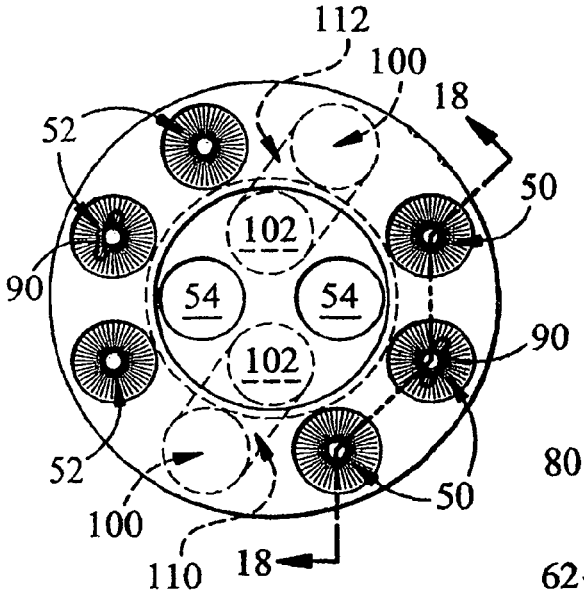
FIG. 17 is top view of the insert of FIG. 2 showing the electrodes in position in the channels.

FIGS. 17-19 and 21 show the wire bristle electrodes in the charging channels. FIG. 17 is a view looking down onto insert 40. FIG. 18 is a vertical cross section of the same insert. The Figures show how the wire bristle charging electrodes fit closely into the bores of, and the bristles extend radially so the electrodes have essentially the same diameters or widths of their respective channels 50, 52. Charging electrodes 80 impart a charge to fine particulate contamination in the liquid. The opposing polarity voltages are sufficient to later effect particle agglomeration in the mixing channels; up to about 15,000 volts plus is applied to one electrode assembly and up to about 15,000 volts minus is applied to the other electrode assembly.

From the foregoing and drawings, it will be understood that half the liquid which enters the housing will flow downwardly through the openings of the channels containing positive electrodes and particles therein will become positively charged. And half the liquid will flow downwardly through the openings of channels containing negative electrodes and particles therein will become negatively charged.

As illustrated, each of the two sets of charging channels comprises three parallel channels, each channel having a length which is about that of the insert body 62. In contrast each of the two parallel sets of mixing channels is seen to comprise three channels in series. It is seen that the liquid flow path length of a charging channel is the distance from the entry (top) end of the set to the discharge (bottom) end of the set. That is, the length is nominally the length of the body 40. It is seen that the liquid flow path length through a mixing channel set is similarly the distance between the entry (e.g., at the bottom of channel 100) and the exit (e.g., the top of channel 54). That is, the path length comprises three channels 100, 102, 54 connected in series together with the paths through the cavities in the upper and lower caps; and thus, the path length is nominally at least three or more lengths of the body 40.

Thus, each mixing flow path length is nominally three or more times greater than the two identical charging channel set path lengths. There are two u-bends, or flow reversals, pictured along the length of each mixing channel path. If the initial flow direction reversal in cavity 120 is counted, there are three u-bends or reversals downstream of the charging channels. As shown in the drawings, that all channels have the same diameter. Thus, they show that the total cross sectional entry area of one set of mixing channels (e.g., the area of channel 100) is one third the total cross sectional entry area of one set of charging channels (i.e., the total of the areas of the openings of the three channels 52).

In the embodiments of the present invention described above, it will be recognized that individual electrodes and/or features thereof are not necessarily limited to a particular embodiment but, where applicable, are interchangeable and can be used in any selected embodiment even though such may not be specifically shown.

Spatially orienting terms such as upper, lower, bottom, vertical, and the like, refer to the positions of the respective elements shown on the accompanying drawing figures; and the present invention is not necessarily limited to such positions.

Although this invention has been shown and described with respect to one or more embodiments, it will be understood by those skilled in the art that various changes in form and detail thereof may be made without departing from the spirit and scope of the claimed invention.

I claim:

1. In apparatus used for treating a non-conducting liquid stream to enable removal of particles suspended in the liquid, which comprises means for dividing a stream of liquid into two separate flow stream halves; means for contacting a first flow stream half with an electrode charged to a positive voltage while flowing the liquid along a first charging channel flow path having a circular cross section and a width, to thereby positively charge particles within the liquid; means for contacting a second flow stream half with an electrode charged to a negative voltage while flowing the liquid along a second charging channel flow path having a circular cross section and a width, to thereby negatively charge particles within the liquid; means for merging the first and second flow stream halves, positioned downstream from said means for contacting, to form a merged stream; and, means for flowing said merged stream along a mixing flow path; wherein an improvement which comprises: electrodes within each said charging channel flow path, wherein each electrode is comprised of a multiplicity of metal wire bristles arranged in a row which runs helically along a length of a conductive post; wherein, bristle portions of each electrode have a width which is the same as a width of the circular cross section of the charging channel flow path with which each electrode is associated; and wherein, helical turns of the row of bristles are spaced apart about one-quarter inch, center to center.

2. The apparatus of claim 1 further comprises three parallel first charging channel flow paths and three parallel second charging channel flow paths, wherein each means for contacting comprises a set of three parallel spaced apart electrodes; further comprising a bus interconnecting the three electrodes.

3. Apparatus for treating a non-conducting liquid stream to enable removal of particles suspended in the liquid, which comprises:

a housing having an interior cavity and an inlet and exit;

a cylindrical insert, contained within the housing interior cavity and made of non-conductive material, the insert having a cylindrical length and an upper end, a lower end, and a central portion disposed along said length; the central portion having a plurality of mutually adjacent charging and mixing channels running lengthwise between the upper end and the lower end of the insert; wherein both said upper end and said lower end are configured for flowing liquid amongst different multiplicities of channels within said plurality of channels; wherein said upper end has at least one port in fluid communication with said housing inlet and at least one port in fluid communication with said housing exit; and, wherein said plurality of channels comprise (a) a multiplicity of first charging channels, each charging channel having a charging electrode disposed therein, for downward flow of liquid;

(b) a multiplicity of second charging channels, each charging channel having a charging electrode disposed therein, for downward flow of liquid;

(c) a multiplicity of mixing channels for upward and downward flow of the liquid received from said multiplicities of charging channels wherein all said channels are cylindrical in shape, have equal lengths, and have lengths which are parallel to the length of the insert; wherein, each charging electrode comprises a plurality of metal wire bristles and a conductive post having a length lying along the length of the charging channel in which the electrode is disposed; wherein the plurality of metal bristles of each charging electrode helically turn around the length of the conductive post such that the helical turns of the metal bristles are spaced apart vertically; wherein a width of each electrode is substantially as the same as a width of the circular cross section of the charging channel within which the electrode is disposed; and, wherein the conductive posts are interconnected at the lower end of the insert.

4. The apparatus of claim 3 wherein the multiplicity of first charging channels is diametrically opposite the multiplicity of second charging channels within said insert.

5. The apparatus of claim 3 wherein all the charging channels and at least two mixing channels are circumferentially spaced apart within the insert proximate the cylindrical periphery thereof, and where the two mixing channels separate one said multiplicity of charging channels from the other multiplicity of charging channels.

6. The apparatus of claim 3 wherein the multiplicity of mixing channels comprises (i) a first set of mixing channels for upward flow of the liquid received from said multiplicities of charging channels;

(ii) a second set of mixing channels for downward flow of the liquid received from the first set of mixing channels; and, (iii) a third set of mixing channels for upward flow of the liquid received from the second set of mixing channels.

7. The apparatus of claim 6 wherein the total length of all the mixing channels is at least three times greater than the length the charging channels within one of said multiplicities of charging channels.

8. The apparatus of claim 6 wherein the total cross sectional area of all the charging channels is triple the total cross sectional area of all the channels in the first multiplicity of mixing channels.

9. The apparatus of claim 3 wherein the insert non-conductive material is nylon.

* * * * *